United States Patent [19]

Flory

[11] 4,088,089

[45] May 9, 1978

[54] RISER AND YOKE MOORING SYSTEM

[75] Inventor: John F. Flory, Morris Township, Morris County, N.J.

[73] Assignee: Exxon Research & Engineering Co., Linden, N.J.

[21] Appl. No.: 756,122

[22] Filed: Jan. 3, 1977

Related U.S. Application Data

[63] Continuation-in-part of Ser. No. 636,023, Nov. 28, 1975, abandoned.

[51] Int. Cl.[2] ..... B63B 21/50

[52] U.S. Cl. ..... 114/230; 9/8 P

[58] Field of Search ..... 114/230, 293, 144 B, 114/264, 265; 175/5, 7; 9/8 P; 166/.5; 141/279, 387, 388; 61/46

[56] References Cited

U.S. PATENT DOCUMENTS

| | | | |
|---|---|---|---|
| 3,155,069 | 11/1964 | Ross et al. | 114/230 |
| 3,167,049 | 1/1965 | Foster | 114/144 B |
| 3,442,245 | 5/1969 | Christians et al. | 114/230 |
| 3,540,396 | 11/1970 | Horton | 114/265 |
| 3,601,187 | 8/1971 | Tidwell | 175/7 |
| 3,641,602 | 2/1972 | Flory et al. | 9/8 P |
| 3,700,014 | 10/1972 | Scales et al. | 9/8 P |
| 3,823,432 | 7/1974 | Van Heijst | 9/8 P |
| 3,894,582 | 7/1975 | Kammerer | 166/.5 |
| 3,908,212 | 9/1975 | Van Heijst | 9/8 P |
| 4,003,473 | 1/1977 | Ryan | 114/230 |
| 4,023,517 | 5/1977 | Ryan | 114/230 |

FOREIGN PATENT DOCUMENTS

| | | | |
|---|---|---|---|
| 1,384,983 | 2/1975 | United Kingdom | 114/230 |

*Primary Examiner*—Trygve M. Blix
*Assistant Examiner*—Stuart M. Goldstein
*Attorney, Agent, or Firm*—F. Donald Paris

[57] ABSTRACT

A vessel such as a storage vessel is permanently moored, by means such as a yoke pivoted on the forecastle of the vessel, to a mooring leg, e.g. a riser or anchor chain, which is attached to a base located on the ocean floor. Mounted on the vessel is tension existing means, for example, counterweights, springs, winches, or the like, operably connected with the mooring leg for applying tension thereto such as by lifting the yoke. The top of the mooring leg is connected to the end of the yoke through a mooring swivel and a gimbaled mooring table or a universal joint. A fluid swivel may be located above the mooring table or about a load-carrying shaft connected to the mooring leg.

48 Claims, 10 Drawing Figures

10
12
14
16
18
20
24
26
28
30
32
34
38
38a
38b
40
42
44
48
50
60
62
64
102
104
106

Fig. 3.
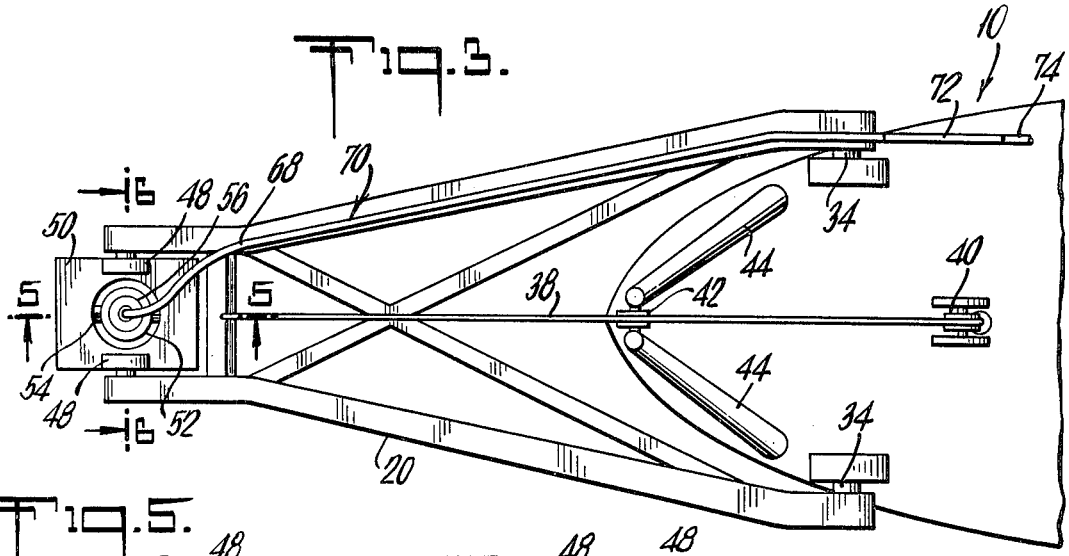
Fig. 5.
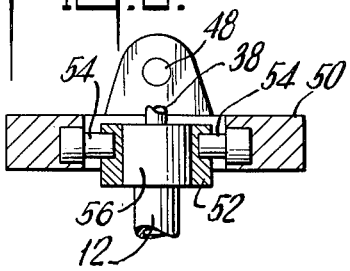
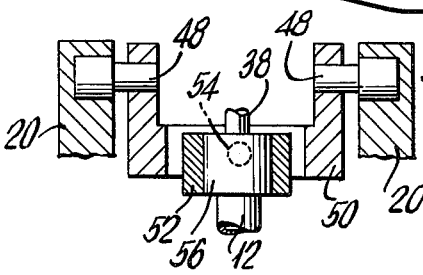
Fig. 6.
Fig. 4.
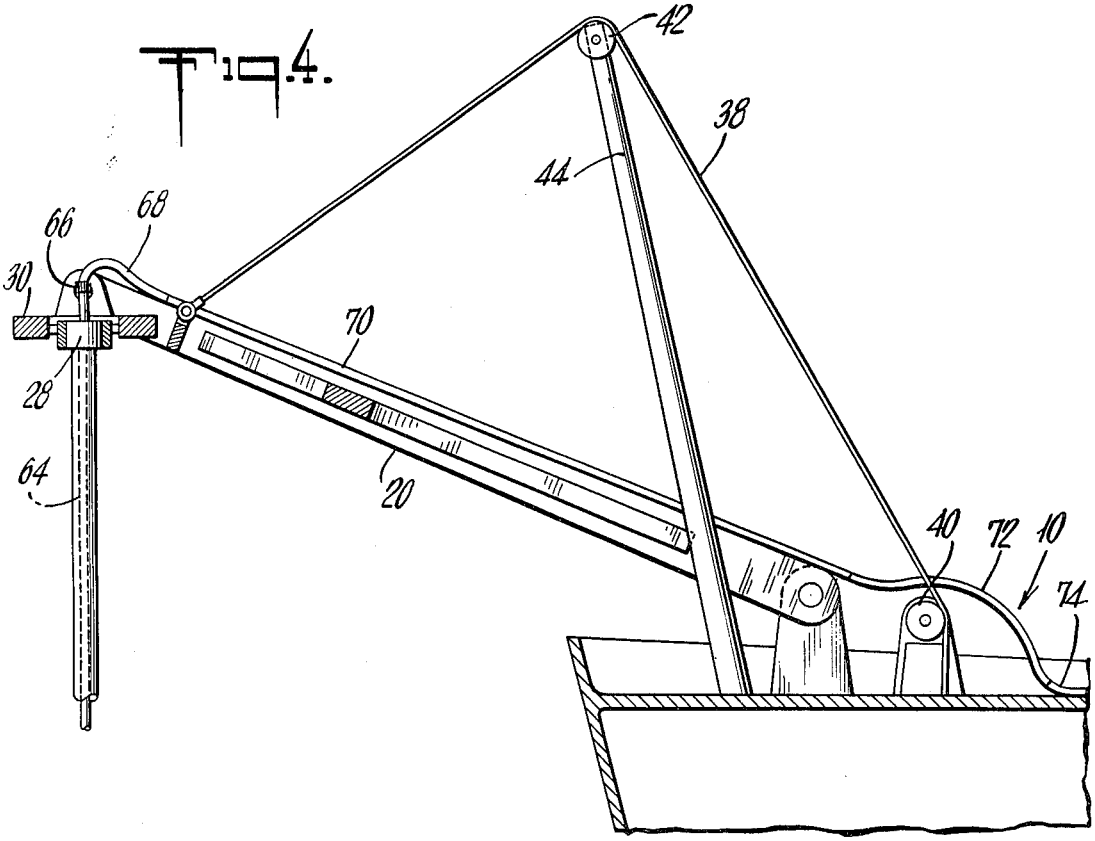

10
14
16
18
20
24
26
28
30
32
34
38
40
42
44
48
60
102
104
106
116
128
130
132
134
136
138
140
142

RISER AND YOKE MOORING SYSTEM

CROSS-REFERENCE TO RELATED APPLICATIONS

This application is a continuation-in-part of U.S. application Ser. No. 636,023, filed Nov. 28, 1975, (and now abandoned) which is incorporated herein by reference.

BACKGROUND OF THE INVENTION

In many situations, it is desirable to permanently moor vessels in the ocean, such as storage vessels to receive and store crude oil from an offshore oil field. Such storage vessels are usually extensively modified tankers or barges. In mild environments the storage vessel may be moored by bow hawsers to a single anchor leg mooring or other conventional mooring system. However, storage vessels are frequently located far off shore in severe environments, and, because the storage vessel must remain moored even in storms, high mooring forces are imposed on the mooring system. If the storage vessel is to remain permanently moored, the mooring system must be designed to withstand the highest forces imposed by the most severe environment at the site. To lessen corrosion and wear, it is desirable to have mechanical components, such as mooring and cargo swivels, located so that they will not be subjected to continuous salt water immersion or alternate wetting and dry action which may cause failure of seals and bearings. Because the mooring is permanent, it is further desirable in certain instances to locate swivel seals and bearings where they can be conveniently inspected and maintained.

Several suitable permanent moorings for storage vessels have been of the single anchor leg mooring design, for example see U.S. Pat. Nos. 3,641,602, 3,614,869, and 3,708,811. Other permanent moorings for storage vessels have been of the catenary anchor leg design, for example see U.S. Pat. Nos. 3,538,880 and 3,823,432. However, in both types of such moorings the buoy, located at the water surface, is subjected to high wave forces which increase peak mooring forces. In the single anchor leg mooring the mooring swivel and fluid swivels located beneath the water surface must be removed and brought to the surface for maintenance. In the catenary anchor leg mooring, the anchor system is very expensive, especially in deep water, and the underwater cargo hose system requires frequent maintenance. Other types of permanent mooring systems which employ a yoke type connection are disclosed in U.S. Pat. Nos. 2,882,536 and 3,908,212.

SUMMARY OF THE INVENTION

The present invention relates to moorings and more particularly to a permanent mooring for a vessel such as a storage vessel. According to a preferred embodiment of the present invention in its broadest aspect, there is provided a system for mooring a vessel, typically a tanker, barge or the like, floating on the surface of a body of water, with tension-carrying means, comprising a riser pipe or an anchor chain, which is connected to the bottom of the body of water. Tension-exerting means, provided on the vessel, are connected for coaction with the tension-carrying means for exerting tension on it in order to restore it to a vertical position when it deviates therefrom due to movement of the vessel. Cargo carrying means, including a fluid swivel mounted about a load-carrying shaft, forming part of the mooring leg, is connected between the vessel and piping on the bottom of the body of water. Also according to the present invention, the storage vessel is permanently moored by means of a yoke that is pivoted on the forecastle of the vessel to a riser, which is pivotally attached to a base situated on the ocean floor. The yoke is constantly forced upward by suitable means, such as counterweights, springs, or winches, connected to the yoke and located on the vessel. The force also can be directly applied to the riser or anchor chain. The top of the riser is connected to the end of the yoke by a mooring swivel and a gimbaled mooring table or a universal joint. The fluid swivel is located above the mooring table or about a load-carrying shaft situated below the universal joint. In the present invention the mooring swivel and fluid swivels preferably are situated relatively high above the water surface, so that they will not be subjected to salt water immersion or any alternating wetting and drying action. This swivel location not only prevents failure of seals and bearings but also facilitates inspection and maintenance in contrast to underwater swivels. It is also, however, within the contemplation of this invention to locate the swivels below the water surface.

The present invention can readily be contrasted with a conventional single anchor leg mooring system which relies principally on net buoyancy of the buoy for its restoring elasticity, and which thus permits little variability in the mooring elasticity. The shape of the elasticity curve for the present mooring system can be designed to be more optimum by proper selection of the length of the yoke, of the locations of the mooring yoke pivot points and the cable sheave points, and of the mass of the counterweight, or by the use of variable spring rate devices or other special mechanical arrangements. Damping of the motion of the counterweight, and thus of the yoke and the complete mooring system, can be accomplished by controlled introduction of a fluid into a tank or appropriate chamber which houses the counterweight on the vessel. A yoke, when used, according to the present invention will restrain the permanently moored storage vessel against sway and yaw relative to the mooring and will also prevent it from surging forward on a slack line. Because in the present system the mooring elasticity curve can be more nearly optimized than in conventional mooring systems, and because surge, sway, and yaw motions are minimized, the mooring forces on the present system are expected to be substantially less than those of a conventional mooring system. The absence of a buoy at the water surface in the present system will further reduce forces on the mooring system.

Having in mind the foregoing which will be evident from an understanding of the disclosure, the invention comprises the combination, arrangement and parts disclosed in the presently preferred embodiment of the invention which is hereinafter set forth in such detail as to enable those skilled in the art readily to understand the function, operation, construction and advantages of it when read in conjunction with the accompanying drawings.

BRIEF DESCRIPTION OF THE DRAWINGS

FIG. 3 is an enlarged top plan view of the riser and yoke mooring system of FIG. 1.

FIG. 4 is an enlarged side view of the riser and yoke mooring system of FIG. 1.

FIG. 5 is a cross-sectional view taken substantially on the line 5—5 of FIG 3.

FIG. 6 is a cross-sectional view taken substantially on the line 6—6 of FIG. 3.

DESCRIPTION OF THE PREFERRED EMBODIMENT

Figures 1, 2:
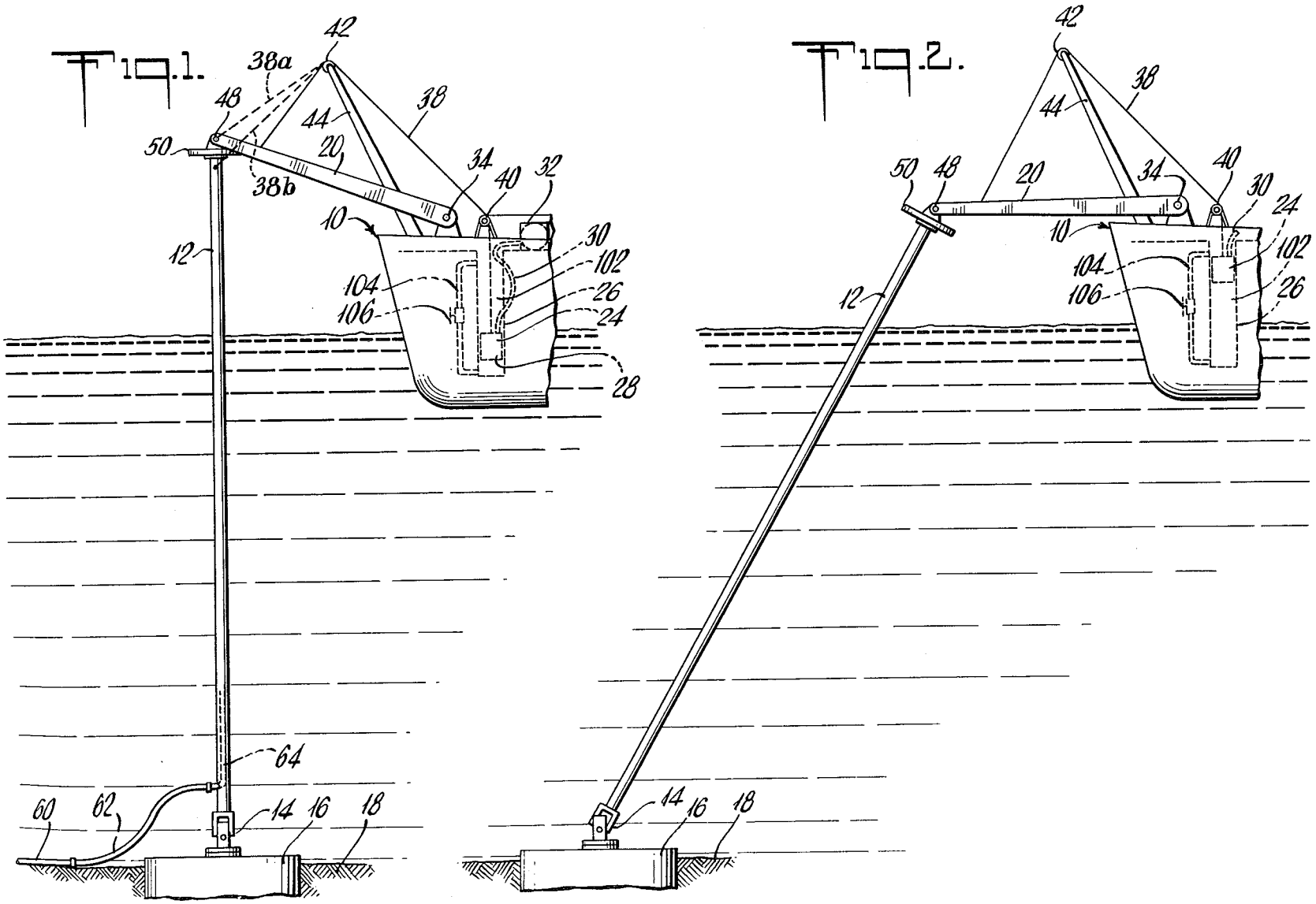
FIG. 1 illustrates a riser and yoke mooring system according to the present invention, with the riser in its undeflected position.
FIG. 2 illustrates a riser and yoke mooring system according to the present invention, substantially like that of FIG. 1, except with the riser in a deflected position as influenced by high mooring forces.

Referring now to the drawings, wherein like parts are designated by the same reference numerals throughout the several views, there is shown in FIG. 1 a storage vessel generally designated 10 which is permanently moored to the sea floor 18 by a mooring system comprising a structural member such as yoke 20, a mooring leg shown as a riser 12, and a base 16. The vessel shown in a typical modified tanker. It is recognized, however, that other types of vessels such as barges, also may be employed. The base is conventionally secured by virtue of its mass or by means of piles (not shown) to the sea floor 18. The riser 12 is pivotally attached to the base 16 through a conventional universal joint 14 which permits the riser to pivot in any vertical plane. It is recognized that in relatively deep water the mooring leg can be fixedly secured to the sea floor without benefit of a pivot or universal joint, since the small flexure of the riser pipe or other mooring leg member will accommodate movement from its normal vertical axis. The free end of the riser preferably can extend above the surface of the sea. It is also within the contemplation of the present invention to locate the free end of the riser or other type of mooring leg employed beneath the surface of the sea as the situation warrants.

The yoke 20 is pivoted at one end on pins 34 located on opposite sides of the vessel and on an axis transverse to the centerline of the tanker. The yoke is thus free to pivot in a plane vertical with respect to the vessel and containing the vessel centerline, but is restrained against pivoting in a plane horizontal with respect to the vessel. The free end of the yoke extends beyond the bow of the tanker and is connected to the upper end of the riser through the mooring swivel 56 and the gimbaled mooring table 50. While the present preferred embodiment is shown as employing the yoke, it is also possible to design a system which utilized certain basic features and concepts of the present invention without employing a yoke per se. Thus, as shown in certain figures which illustrate modification of the present invention, FIG. 10 in particular, the mooring design can include the use of the mooring leg directly connected between the tension-exerting means on the vessel and the sea floor. This will be explained in further detail hereinafter.

The mooring table 50 is pivoted at the free end of the yoke 20 on horizontal pins 48 having their axis parallel to the axis of the yoke pivot pins 34. The mooring swivel 56 is housed in a mooring ring 52 which is pivoted on pins 54 on an axis in the plane of the mooring table 50 and in a plane vertical with respect to the vessel and passing through the centerline of the vessel. The mooring ring 52 is thus free to gimbal, that is it is free to tilt in any direction with respect to the yoke 20.

The mooring swivel 56, designed to withstand substantial axial thrust, is housed between the mooring ring 52 and the top of the riser 12, and is coaxial with the centerline of the riser. The mooring table 50 is thus free to rotate around the riser 12. This permits the yoke 20 and the vessel 10 to swing completely around the riser 12 and thus swing freely about the mooring base 16.

The outer end of the yoke 20 is lifted upward by means such as cable 38 running to a counterweight 24 located in a tank or chamber 26 in the hull of the vessel 10. Cable 38 is guided over a sheave 42 mounted on posts 44 and over sheave 40 located over the center of chamber 26. The lifting action imparted on the yoke 20 by the counterweight 24 exerts tension on the riser 12. This tensioning action is analogous to the tension applied by the buoy to the anchor leg of a conventional single anchor leg mooring. When environmental forces cause the vessel 10 to move from the neutral position, as shown in FIG. 1, the riser 12 pivots from its normal vertical orientation about the base universal joint 14 into a position such as shown in FIG. 2. Deflection of the riser causes the yoke 20 to dip down, thus lifting the counterweight 24. The vertical component of force in the riser remains essentially the same at any position of deflection, changing slightly with the change in geometry of the system. However, the horizontal component of tensile force in the riser in the deflected position exerts a restoring force tending to draw the vessel back to the neutral position.

In a typical installation, with the base installed in 360 ft. of water and with the riser extending 100 ft. above the water in the undeflected position, the mooring table will drop from 100 ft. to 40 ft. above the water when the moored vessel moves 230 ft. from the neutral position. At this position, the riser is deflected 30° from the vertical and the horizontal force is half of the tension force in the riser. If the cable 38 forms an angle of approximately 60° with the yoke in this deflected position, and is attached at a point near or at the outer end of the yoke, then the horizontal restoring force will be approximately half the weight of the counterweight 24 in the position just described. As shown by the dotted lines in FIG. 1, the tension exerting cable 38 also may be connected directly to the mooring table (38*a*) at an appropriate location, or may be connected directly to the riser (38*b*) either above or beneath the seal surface.

The counterweight 24 may be partially filled with a liquid 28, such as water or drilling mud. The mass of the counterweight may be changed by pumping liquid to or from the counterweight by a conventional pump 32 connected to the counterweight through a hose 30.

Fluid cargo may be transferred between the vessel 10 and an underwater pipeline 60 by a system generally comprising hose 62 between the pipeline and piping 64 housed within, as shown in FIG. 1, or attached externally to the riser 12. A fluid swivel 66 mounted on the mooring ring 52 and connected to riser piping 64 as shown in FIG. 4, allows cargo to flow while the vessel rotates about the mooring. Cargo piping 70 on the yoke is connected through hose 68 to the fluid swivel 66 and through hose 72 to piping 74 onboard the vessel. These flexible hose connections account for relative pivoting between the mooring table, the yoke, and the vessel.

Figure 7:
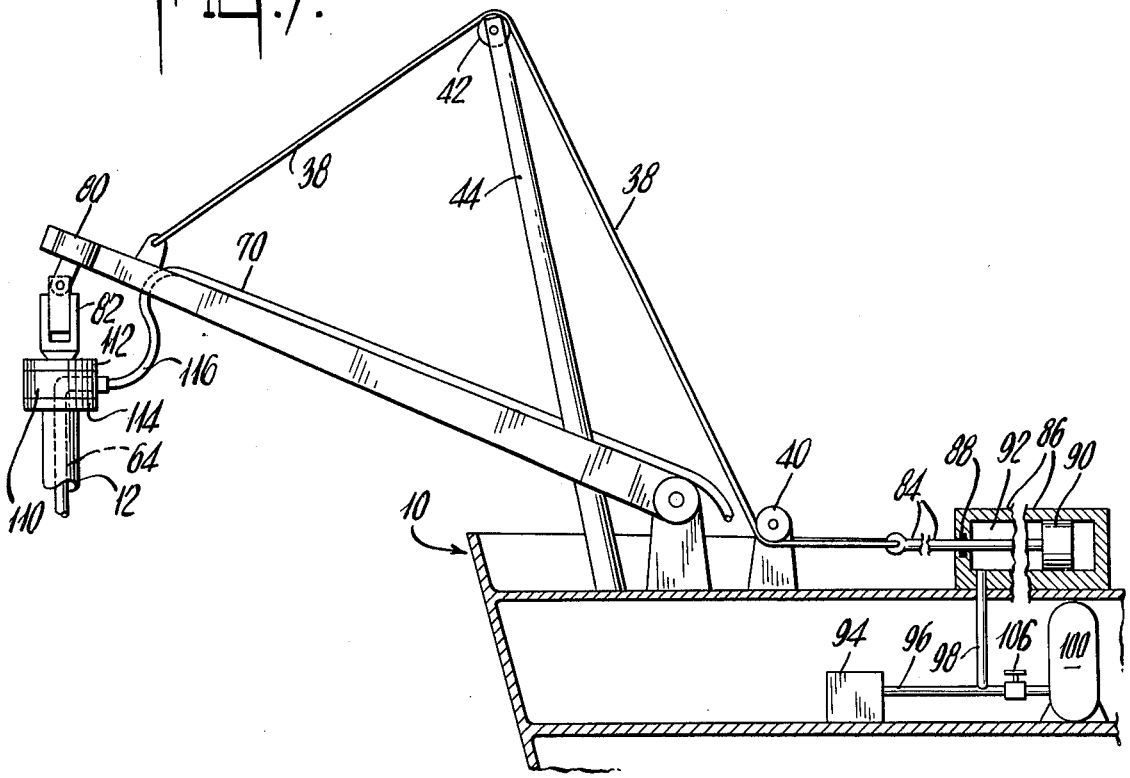
FIG. 7 is an alternate embodiment of the present invention wherein a cylinder and piston apply the force.

In FIG. 7 an alternate embodiment of the present invention is shown in which a mooring swivel 80, designed to withstand substantial axial thrust, is housed near the upper end of the yoke 20 and with its axis substantially perpendicular to the plane of the yoke. The riser 12 is pivotally attached to the mooring swivel 80 through the universal joint 82 which permits the yoke 20 and the vessel 10 to swing completely around the riser 12 and thus swing freely about the mooring base 16.

The outer end of the yoke 20 is lifted upward by means such as cable 38 running over sheave 42 mounted on posts 44, under sheave 46 mounted on the deck of the vessel 10 and connected to a resilient system including a shaft 84 projecting from cylinder 86. Cylinder 86 is firmly mounted to the deck of the vessel. Shaft 84 enters cylinder 86 through a seal 88, and is attached to a piston 90 in sealed sliding contact with the interior of the cylinder, which divides the cylinder into upper and lower chambers of variable volume. When the upper chamber 92 of the cylinder 86 is filled with a pressurized gas or liquid, the piston 90 and shaft 84 are forced downward (to the right in FIG. 7), thus exerting tension in cable 38, lifting yoke 20 upward and exerting tension on the riser 12. As explained above with reference to the preferred embodiment of FIGS. 1–6, this tensioning of the riser 12 tends to restore the mooring and the moored vessel 10 to a neutral position whenever it is disturbed by environmental forces. The pressure within the chamber 92 may be varied though an external pump 94 connected to the chamber through piping 96 to control tension in the cable 38 and in the riser 12, thus changing the characteristics of the mooring system to best suit the environmental conditions.

An external tank 100 may be joined to the piping through a valved orifice 106. Changes in pressure within the chamber 92, caused by changes in the tension in riser 12, will force gas or liquid to flow between the chamber and the tank 100. This flow of liquid or gas will be dampened as it flows through the orifice 106, thus dampening motion of the vessel on the mooring system. The dampening action can be varied by changing the size of the orifice 106. Dampening may be exerted on the mooring system described as the preferred embodiment by placing a liquid 102, such as oil or water, within the counterweight chamber 26. This damping action may be enhanced by making the clearance between the walls of the chamber 26 and the counterweight 24 small. This dampening action may be varied by providing piping or conduit 104 between the upper and lower portions of the chamber on opposite sides of the counterweight 24, as shown in FIG. 1, and by controlling the opening of a valved orifice 106, within this piping to regulate flow therethrough.

Again referring to FIG. 7, the piping 64 within the riser 12 communicates with a conduit formed within a load carrying center shaft (not shown) mounted at the top of the riser and directly below the universal joint 82. This load carrying center shaft is surrounded by a fluid swivel housing 110 mounted on upper and lower fluid swivel joints 112 and 114, which comprises a fluid swivel assembly such as described in U.S. Pat. No. 3,606,397. Cargo flows through the piping 64 to the rotatable housing 110 and then through flexible hose 116 to cargo piping 70 on the yoke 20. If desired, the piping 64 can be situated externally of the riser 12, being secured adjacent its outer surface.

Figure 8:
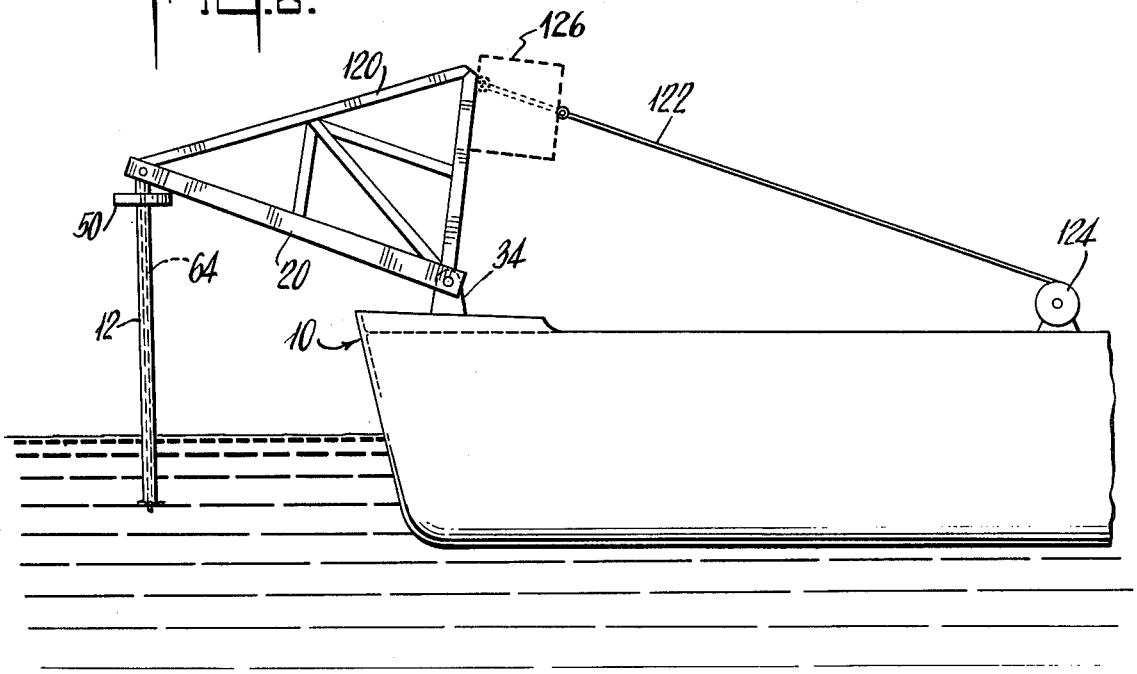
FIG. 8 is another alternate embodiment of the present invention wherein a winch applies the force.

In FIG. 8 another alternate embodiment of the present invention is shown in which a rigid frame structure 120 is mounted on the rigid yoke 20. A cable 122 runs from winch 124 mounted on the deck of the vessel 10 to the top of the rigid frame 120. Tension applied by the winch 124 through the cable 122 causes rigid frame 120 and rigid yoke 20 to pivot about the yoke pivot pins 34, thus lifting the outer end of the yoke 20 and exerting tension on the riser 12. As explained above with reference to the preferred embodiment, this tensioning of the riser 12 tends to restore the mooring and the mooring vessel 10 to a neutral position whenever it is disturbed by environmental forces. Another version may include the location of a counterweight 126 directly on the framework structure 120 at the vessel end as shown schematically by dotted lines, which would avoid the need for employing the cable 122 and associated winch mechanism 124.

Winch 124 may be of the constant tension type, which which exerts a constant tension in the cable 122 while allowing cable to the reled out or reeled in. Alternatively, the cable 122 may be of an elastic material, such as nylon, which will elongate under tension. If the cable 122 is of an elastic material, the end of the cable may be fastened to a strong point on the deck of the vessel 10, instead of to the winch 124.

Figures 9, 10:
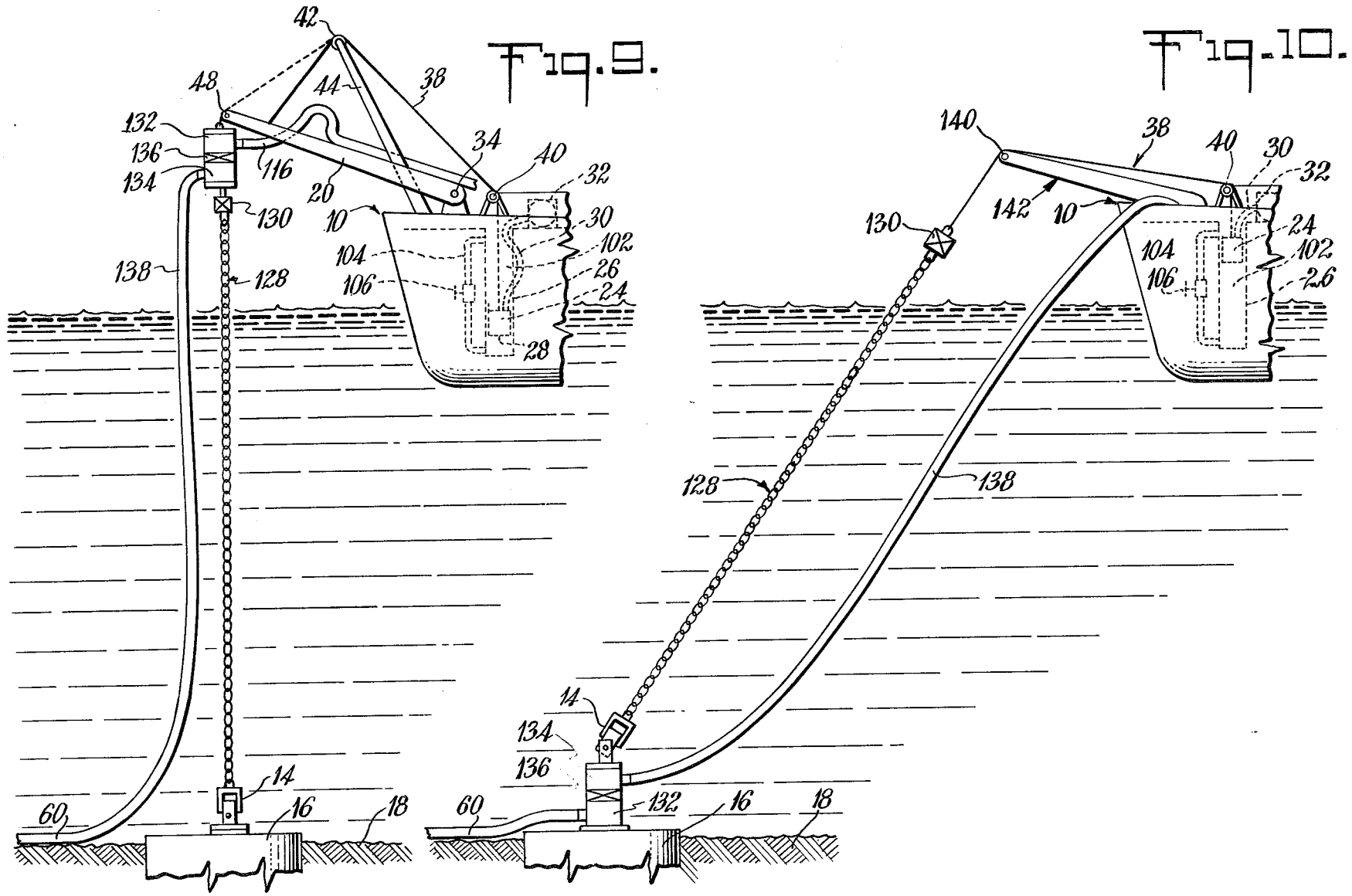
FIG. 9 illustrates an alternate embodiment of the present invention, wherein the mooring leg comprises an anchor chain instead of a riser pipe.
FIG. 10 is a further modification wherein the mooring leg, shown as an anchor chain, is employed, with the yoke having been omitted.

FIG. 9 illustrates basically the same overall arrangement of the preferred embodiment of FIGS. 1 and 2; however, instead of employing a rigid pipe for the riser 12, the mooring leg comprises an anchor chain 128 connected at one end to the base 16 and at the other or upper end to the outboard end of the rigid yoke 20. The connection of the upper end of the mooring leg to the tension exerting cable 38, either directly or via the yoke, accomplishes the same function described heretofore with reference to the riser pipe, namely exerting tension on the mooring leg in order to cause the vessel to restore to its desired position. Typical use of a mooring leg including an anchor chain can be found in the aforementioned single anchor leg mooring U.S. patents. An anchor chain swivel 130 may be included in the mooring leg to accommodate rotation of the vessel about the mooring point. A fluid swivel assembly, such as that disclosed in U.S. Pat. No. 3,606,397, may also be included in the mooring leg comprising a load-carrying center shaft (not shown) below the yoke an upper housing 132 fixed to this shaft, and a lower housing 134 rotatably mounted on the shaft through swivels 136. Flexible hose 138 connects an underwater pipeline 60 with the lower housing 134, and another hose 116 connects the upper housing 132 to piping on the yoke 20.

Yet another version of the present invention is shown in FIG. 10, wherein the mooring leg comprises the chain 128 which is connected at its free or upper end directly to the cable 38. The cable 38 extends over a sheave 140 on the free or outboard end of yoke 142 to means onboard the vessel for exerting tension thereon, such as those described above, in order to induce tension in the chain. The chain is normally held in a vertical position by the tension applied at its upper end. When the vessel is deflected such that the chain is no longer vertical, the horizontal component of the tension in the chain creates the restoring force which brings the vessel back to its normal and desired position. Thus, any external force which causes the leg to deviate from its normal substantially vertical position would cause horizontal restoring forces to develop in the leg which draws it back to its normal substantially vertical position.

An anchor swivel 130 may be incorporated in the mooring leg. As the cable 38 is connected directly to the mooring leg 128, it is not necessary that the yoke 142 pivot in the manner of the yokes described in the previously described embodiments. A fluid swivel assembly may be incorporated in the mooring leg in the manner described with reference to FIG. 9. An alternative position of the fluid swivel assembly is shown in FIG. 10 in which the load carrying shaft (not shown) and the fixed housing 132 are mounted on the base 16 and the rotatable housing 134 is mounted on swivels 136 to permit it to rotate continuously about the center shaft. The base universal joint 14 is mounted on the top of the center shaft. Cargo flows from the pipeline 60 through the fluid swivel assembly and up through flexible hose 138 to the moored vessel.

While a preferred embodiment and various modifications thereof have been disclosed, it will be apparent to those of ordinary skill in the art upon reading this disclosure, that other modifications and variations can be made. Accordingly, reference should be made to the appended claims for determining the full and complete scope of the present invention.

What is claimed is:

1. A mooring system for a vessel floating offshore in a body of water comprising: riser means attached to the bottom of said body of water and extending above the surface of said body of water in a normal substantially vertical position; rigid yoke means pivotally connected at one end to said vessel and at the other end to said riser means; means for permitting rotational movement of said vessel about said riser means; means for exerting tension on said riser means located on said vessel and operably connected with said rigid yoke means to restore said riser means to said normal substantially vertical position when motion of said vessel causes said riser means to deflect from said vertical position.

2. The system of claim 1 including pivotal means connecting said riser means to said bottom.

3. The system of claim 2 including mooring swivel means located between said riser means and said rigid yoke means.

4. The system of claim 2 wherein said rigid yoke means is pivotally connected with said vessel for movement in a substantially vertical plane.

5. The system of claim 4 wherein said rigid yoke means is connected to said riser means through gimbal means for permitting pivotal movement thereof in two mutually perpendicular substantially vertical planes.

6. The system of claim 5 including mooring swivel means connected between said riser means and said gimbal means.

7. The system of claim 6 including cargo conduit means operably associated with said riser means and cargo swivel means mounted on said gimbal means and operably connected with cargo conduit means and with further conduit means on said rigid yoke means.

8. The system of claim 4 wherein said means for exerting tension comprises a counterweight.

9. The system of claim 8 wherein said counterweight is connected to said rigid yoke means by at least one flexible tension member.

10. The system of claim 9 including a chamber on said vessel and wherein said counterweight is housed in said chamber.

11. The system of claim 10 wherein said chamber is at least partially filled with a fluid.

12. The system of claim 11 wherein said counterweight is in substantial sealed sliding relationship with the sides of said chamber and including at least one passage connecting said chamber between one side of said counterweight and the opposite side of said counterweight.

13. The system of claim 12 including orifice means in said passage.

14. The system of claim 13 including means for varying the flow of fluid through said orifice means.

15. The system of claim 8 including means for varying the mass of said counterweight.

16. The system of claim 4 wherein said means for exerting tension comprises resilient means.

17. The system of claim 16 wherein said resilient means is connected to said rigid yoke means by at least one flexible tension member.

18. The system of claim 17 wherein said resilient means comprises a shaft connected to a piston in sealed relationship with a pressurized cylinder.

19. The system of claim 18 including pump means for varying the pressurization within said cylinder.

20. The system of claim 18 including a tank connected to said cylinder through at least one passage.

21. The system of claim 20 including an orifice in said passage.

22. The system of claim 21 including means for varying the opening of said orifice.

23. The system of claim 4 wherein said mooring swivel means is connected to said riser means through universal joint means for permitting pivotal movement thereof in two mutually perpendicular substantially vertical planes.

24. The system of claim 23 including fluid housing means rotatably mounted about said riser member.

25. The system of claim 1 including mooring swivel means mounted to said riser means for permitting relatively free swinging movement of said vessel about a mooring point.

26. The system of claim 25 including cargo swivel means for cooperation in the transfer of cargo between said vessel and said riser means operably associated with said riser means, said cargo swivel means being situated above the surface of said body of water with said mooring swivel means.

27. The system of claim 1 wherein said riser means comprises an anchor chain.

28. A mooring system for a floating vessel comprising: a foundation secured to the sea bottom; riser means attached to said foundation and extending above the sea surface in a normal substantially vertical position; means for pivotally connecting said riser means with said foundation; rigid yoke means pivotally connected at one end to said vessel and mooring swivel means connecting the other end of said rigid yoke means to said riser means; means for exerting tension on said riser means located on said vessel and operably connected with said rigid yoke means to restore said riser means to said normal substantially vertical position when motion of said vessel causes said riser means to deflect from said vertical position; and cargo conduit means operably associated with said riser means and cargo swivel means operably connected with said cargo conduit means and with further cargo conduit means on said rigid yoke means for facilitating the transfer of cargo between said floating vessel and the mooring system.

29. A mooring system for a vessel floating offshore in a body of water comprising: a mooring leg connected between the bottom of said body of water and extending substantially vertically to a rigid structural member having a fixed and constant length and extending in a radial outward direction from said mooring leg and is connected between a mooring point on said mooring leg and said floating vessel for preventing forward surge of said vessel relative to said mooring leg; means for enabling said vessel to swing about said mooring leg; and means situated onboard said floating vessel and operably connected with one of said mooring leg or said rigid structural member for exerting tension on said mooring leg to restore it to its normally substantially vertical position when said mooring leg is caused to deflect therefrom; and cargo handling means for the transfer of cargo relative to said floating vessel.

30. The system of claim 29, wherein said mooring leg comprises a rigid riser.

31. The system of claim 30, wherein said riser extends above the surface of said body of water.

32. The system of claim 31 including mooring swivel means connected between said riser and said rigid member for enabling swinging movement of said floating vessel completely about said mooring point, said mooring swivel means being located above the water surface.

33. The system of claim 31 wherein said cargo handling means includes cargo swivel means for transferring cargo with respect to said vessel and operably connected with said riser above the water surface.

34. The system of claim 31 wherein the tension exerting means produces a variable restoring force to develop the necessary tension in said riser to restore it to its normal substantially vertical position.

35. The system of claim 31 including means for connecting said rigid member to said vessel for pivotal movement in a vertical direction with respect to said vessel while being restrained against substantial horizontal movement and means at the opposite end for connecting said rigid member with said riser such that said vessel can freely swing completely about said riser.

36. The system of claim 35 wherein the tension exerting means is connected with said rigid member for applying an upward lifting force thereto which exerts tension in said riser.

37. The system of claim 29 wherein said vessel comprises a ship-shaped hull, said rigid member connected at the bow of said hull and extending forward thereof above the water surface to said riser.

38. A system for mooring and the handling of cargo comprising: a vessel floating on the surface of a body of water, a tension carrying mooring leg means having a main axis normally having a substantially vertical orientation and connected at one end at the bottom of said body of water, rigid structural means having a fixed and constant length and attached to said vessel for spacing said tension carrying mooring leg means from said vessel means for enabling said vessel to swing about said mooring leg, and tension exerting means mounted on said vessel and being operably connected with the opposite end of said tension carrying mooring leg means for exerting tension thereon to restore it to a substantially vertical position when said tension carrying mooring leg means is caused to deflect therefrom, and cargo handling means for the transfer of cargo relative to said vessel.

39. The system of claim 38 wherein said structural means is pivotally connected with said vessel.

40. The system of claim 38 wherein said tension exerting means is directly connected with said tension carrying mooring leg means.

41. The system of claim 39 wherein said tension exerting means is connected with said tension carrying mooring leg means through said rigid structural means.

42. The system of claim 38 wherein said vessel is spaced radially from the main axis of said tension carrying mooring leg means and is adapted for relatively free swinging movement with respect thereto.

43. The system of claim 38 wherein said tension carrying mooring leg means includes a rigid riser.

44. The system of claim 43 wherein said riser is connected for pivotal movement at said one end.

45. The system of claim 38 wherein said tension carrying mooring leg means includes an anchor chain.

46. The system of claim 45 wherein said cargo handling means includes a cargo swivel mounted about a load carrying shaft connected with said anchor chain.

47. The system of claim 46 wherein said cargo swivel is situated below the water surface.

48. The system of claim 46 wherein said cargo swivel is situated substantially at or above the water surface.

* * * * *